US009014593B2

(12) United States Patent
Ogata et al.

(10) Patent No.: US 9,014,593 B2
(45) Date of Patent: Apr. 21, 2015

(54) SEALING ASSEMBLY, DEVELOPING DEVICE, PROCESS UNIT, AND IMAGE FORMING APPARATUS INCORPORATING SAME

(71) Applicants: Yasunobu Ogata, Hyogo (JP); Tetsumaru Fujita, Hyogo (JP); Rie Mitani, Hyogo (JP); Takahiro Sanada, Hyogo (JP)

(72) Inventors: Yasunobu Ogata, Hyogo (JP); Tetsumaru Fujita, Hyogo (JP); Rie Mitani, Hyogo (JP); Takahiro Sanada, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/085,114

(22) Filed: Nov. 20, 2013

(65) Prior Publication Data

US 2014/0153958 A1 Jun. 5, 2014

(30) Foreign Application Priority Data

Dec. 5, 2012 (JP) ..... 2012-266198

(51) Int. Cl.
*G03G 15/08* (2006.01)

(52) U.S. Cl.
CPC ..... *G03G 15/0817* (2013.01)

(58) Field of Classification Search
CPC ..... G03G 15/0817; G03G 15/0898
USPC ..... 399/103, 105, 106
See application file for complete search history.

(56) References Cited

U.S. PATENT DOCUMENTS

| | | | | |
|---|---|---|---|---|
| 7,206,535 | B2 * | 4/2007 | Nozawa | 399/103 |
| 8,644,725 | B2 * | 2/2014 | Brown et al. | 399/102 |
| 2008/0279597 | A1 * | 11/2008 | Berg et al. | 399/279 |
| 2010/0092206 | A1 * | 4/2010 | Matsushita et al. | 399/103 |
| 2013/0236217 | A1 | 9/2013 | Nagatomo et al. | 399/281 |

FOREIGN PATENT DOCUMENTS

| | | |
|---|---|---|
| JP | 2001-154480 | 6/2001 |
| JP | 2003-056713 | 2/2003 |
| JP | 2005-201427 | 7/2005 |
| JP | 2007-058056 | 3/2007 |
| JP | 2008-181047 | 8/2008 |
| JP | 2009-003308 | 1/2009 |

* cited by examiner

*Primary Examiner* — Sophia S Chen
(74) *Attorney, Agent, or Firm* — Oblon, McClelland, Maier & Neustadt, L.L.P.

(57) ABSTRACT

A sealing assembly to contact a rotator includes a sealing member to slidably contact a surface of an end of the rotator in an axial direction of the rotator. The sealing member has an end in a circumferential direction thereof to contact the surface of the rotator with a first pressure. The end in the circumferential direction is fixed to a bearing surface formed on the opening on at least one of an upstream side and a downstream side in a rotation direction of the rotator. The sealing member has an intermediate portion between an upstream end and a downstream end in the circumferential direction to contact the surface of the rotator with a second pressure lower than the first pressure.

13 Claims, 16 Drawing Sheets

SEALING ASSEMBLY, DEVELOPING DEVICE, PROCESS UNIT, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2012-266198, filed on Dec. 5, 2012, in the Japan Patent Office, the entire disclosure of which is hereby incorporated by reference herein.

BACKGROUND

1. Technical Field

This disclosure generally relates to a sealing assembly to seal an end of a rotator, such as an image carrier, used in an electrophotographic image forming apparatus, and to a developing device, a process unit, and an image forming apparatus incorporating the sealing assembly.

2. Description of the Related Art

In electrophotographic image forming apparatuses, such as printers, copiers, facsimile machines, and multifunction devices having two or more of copying, printing, and facsimile functions, a fine powder colorant called toner is typically used as developer. In such electrophotographic image forming apparatuses, an electrostatic latent image is formed on an image carrier, such as a photoconductive drum, the electrostatic latent image is developed as a toner image, the toner image is transferred onto a recording sheet, and the toner image thus transferred is fixed on the recording sheet under heat and pressure.

Such toner is stored in, for example, a toner container included in a development unit. A landscape-oriented opening is formed in a lower side surface of the toner container. A developing roller disposed in a transverse direction in the opening is rotated to move a thin layer of the toner held on an outer circumferential surface of the developing roller to a surface of the image carrier such as the photoconductive drum.

Sealing members are disposed at opposed ends of the developing roller or the photoconductive drum to prevent toner leakage. If toner leaks from between the sealing member and the developing roller, an inside of the image forming apparatus may be contaminated with toner, resulting in printing failures and further contamination of hands and/or clothes of an operator upon replacement of the developing device. Particularly, a nonmagnetic one-component developing device is likely to cause toner leakage.

For example, as described in JP-2003-056713-A, a sealing assembly may be disposed at each end of the developing roller or the photoconductive drum. As illustrated in FIG. 9A, such a sealing assembly has a sealing member 335 including felt or the like. A tip of a regulation blade 359 contacts a surface of a developing roller 358 inside the sealing member 335. The sealing member 335 is attached to a bearing surface 328 of a toner container 351 of a development unit. The bearing surface 328 includes an arc surface, a curved surface and a flat surface along the developing roller 358 and the regulation roller 359. It is to be noted that the regulation blade 359 is attached to the toner container 351 via a bracket 359*a* and a screw 359*b*.

As illustrated in FIG. 9B, the sealing member 335 includes a sealing base 335*c*, such as felt or pile, having a predetermined thickness and attached onto an elastic member 335*a* such as sponge or rubber. A double-sided tape 335*d* is attached to a bottom surface of the elastic member 335*a*. The sealing member 335 of FIG. 9B is fixed to the bearing surface 328 of the toner container 351 with the double-sided tape 335*d* as illustrated in FIGS. 9C and 9D and an upper surface of the sealing base 335*c* contacts an outer circumferential surface of each end of the developing roller 358 under predetermined pressure, thereby preventing powder leakage. It is to be noted that a bearing hole 330 is provided to support a shaft of the developing roller 358 as illustrated in FIG. 9C.

However, such a sealing member cannot perfectly prevent powder leakage because, for example, polymerized toner or toner particles having a small diameter have been recently used in image forming apparatuses to achieve higher image quality. In order to maintain reliable sealing performance, the sealing member is pressed against the developing roller under higher pressure, or the sealing member has a relatively large thickness for full compression. As a result, larger heat is generated at the ends of the developing roller because of friction against the sealing member. In addition, an increased pressure force of the sealing member increases torque for rotatively driving the development unit, causing wear of a gear included in a power transmitting assembly and/or banding. Further, downsized and high-speed image forming apparatuses increase the rotation speed of the developing roller, causing larger heat to be generated at the ends of the developing roller by friction against the sealing member. Furthermore, polymerized toner having a low melting point has been recently used to achieve higher image quality and for energy saving. Such polymerized toner is likely to melt and adhere to the ends of the developing roller.

The toner melting and adhering to the end of the developing roller generates gaps among the developing roller, the sealing member and the regulation blade. A large amount of toner leaks through the gaps, causing imaging failures and contamination in the image forming apparatus. In addition, heat generated at the ends of the developing roller exposes the developing roller to high temperatures for a long time. As a result, the surface of the development may peel off and/or the developing roller may be broken.

As described above, a typical sealing assembly using only sealing pressure as a parameter is not enough to maintain reliable sealing performance while using polymerized toner having a low melting point to achieve higher image quality and for energy saving. A two-component developing device prevents toner and/or developer leakage by pressing a magnetic sealing member against a developing roller or a magnetic roller under low pressure. A one-component developing device needs a sealing member with a parameter other than pressure. Hence, a variety of techniques has been proposed to improve sealing performance without increasing a pressure force of the sealing member.

For example, JP-2001-154480-A proposes to prevent a gap from being created between both ends in an axial direction of a sealing member that seals shaft ends of a rotator and edges of a powder conveyance opening to prevent powder leakage.

JP2003-056713-A and JP2005-201427-A proposes use of a sealing member including hollow fiber to improve sealing performance and to reduce torque.

JP-2009-003308-A proposes use of an assisting sponge that absorbs a shearing stress to prevent deformation of a sealing member in a rotational direction caused by friction against a and prevent reduction in sealing performance, thereby preventing powder leakage.

JP2008-181047-A proposes use of different kinds of sealing members contacting a developing roller and a regulation roller, respectively, to improve sealing performance. Specifically, the developing roller contacts a sealing member that reduces sliding friction and the regulation blade contacts a sealing member that prevents powder leakage.

As described above, JP-2001-154480-A proposes to prevent a gap from being created between the sealing member and edges of the opening to prevent powder leakage. However, sealing performance between the sealing member and the rotator is not particularly considered. JP2003-056713-A and JP2005-201427-A proposes to improve sealing performance and to reduce torque by using the sealing member including hollow fiber. However, sealing performance at both ends in a circumferential direction may be insufficient. An object of JP-2009-3308-A is to maintain sealing performance by preventing deformation of the sealing member. Sealing performance between the sealing member and the rotator is not particularly considered. An object of JP2008-181047-A is to improve sealing performance of the regulation blade and sliding properties of the developing roller. Sealing performance for the developing roller is not particularly considered.

SUMMARY

In one exemplary embodiment of the present disclosure, a sealing assembly to contact a rotator includes a sealing member to slidably contact a surface of an end of the rotator in an axial direction of the rotator. The sealing member has an end in a circumferential direction thereof to contact the surface of the rotator with a first pressure. The end in the circumferential direction is fixed to a bearing surface formed on the opening on at least one of an upstream side and a downstream side in a rotation direction of the rotator. The sealing member has an intermediate portion between an upstream end and a downstream end in the circumferential direction to contact the surface of the rotator with a second pressure lower than the first pressure.

Another exemplary embodiment provides a developing device including a developing roller and a sealing assembly. The developing roller is disposed in the opening in a direction traversing the opening, and conveys powder held on a surface thereof from inside to outside an opening by rotation. The sealing assembly includes a sealing member to slidably contact a surface of an end of the developing roller in an axial direction of the developing roller. The sealing member has an end in a circumferential direction thereof to contact the surface of the developing roller with a first pressure. The end in the circumferential direction is fixed to a bearing surface formed on the opening, on at least one of an upstream side and a downstream side in a rotation direction of the developing roller. The sealing member has an intermediate portion between an upstream end and a downstream end in the circumferential direction to contact the surface of the developing roller with a second pressure lower than the first pressure.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of exemplary embodiments when considered in connection with the accompanying drawings, wherein.

Figure 1:
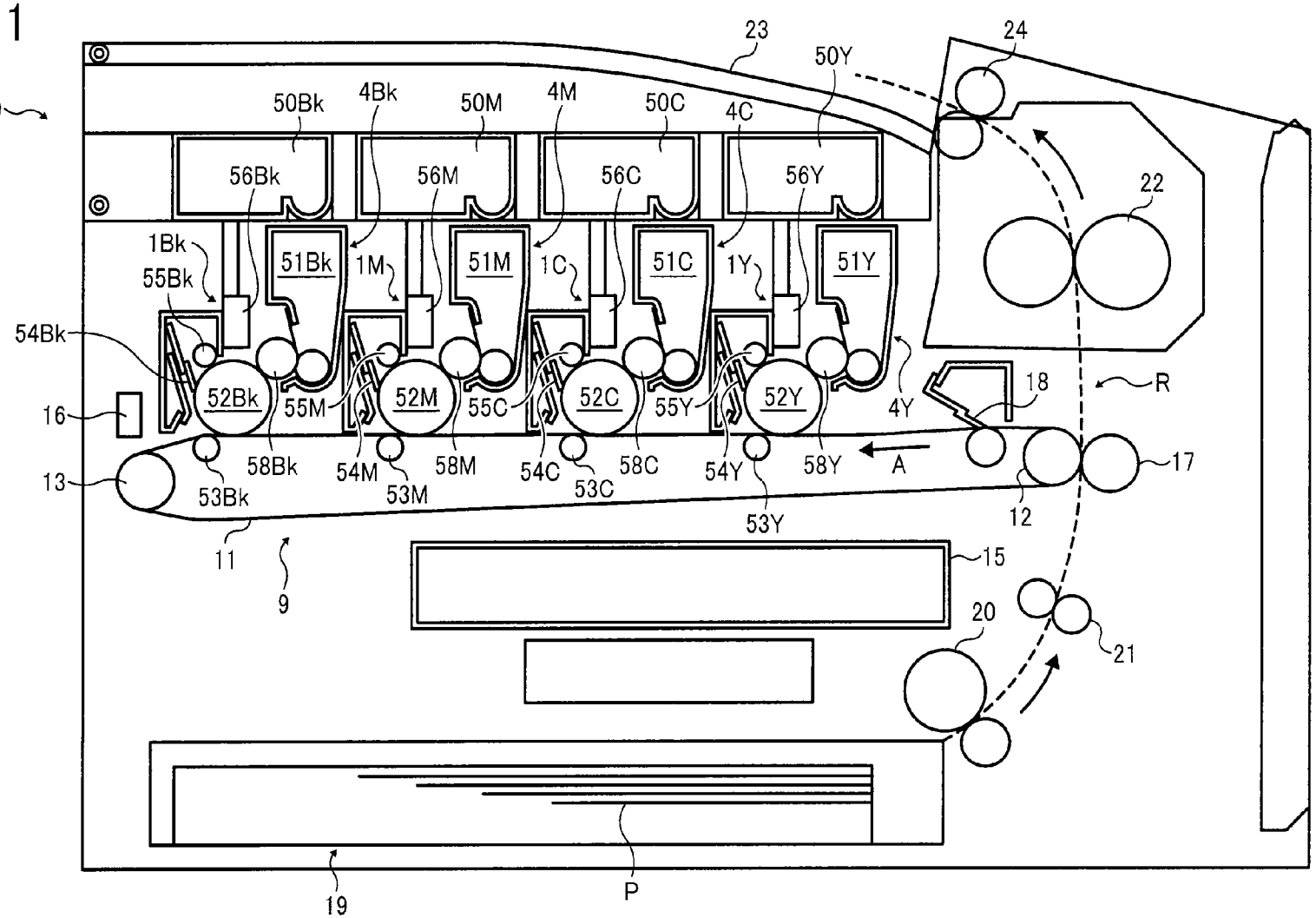
FIG. 1 is a schematic view of an image forming apparatus using a sealing assembly according to some exemplary embodiments of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE INVENTION

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Exemplary embodiments of the present disclosure are now described below with reference to the accompanying drawings.

In a later-described comparative example, exemplary embodiment, and exemplary variation, for the sake of simplicity the same reference numerals will be given to identical constituent elements such as parts and materials having the same functions, and redundant descriptions thereof omitted unless otherwise required.

(Image Forming Apparatus)

A basic configuration of an image forming apparatus according to some exemplary embodiments of this disclosure is described in detail below. The image forming apparatus can be a multifunction device integrally having two or more of copying, printing, and facsimile functions. In the following description, alphabetical letters Y, C, M, and Bk following reference numerals indicate yellow, cyan, magenta, and black, respectively. The alphabetical letters Y, C, M, and Bk may be hereinafter omitted and only the reference numerals are used for describing a configuration of components that are different from each other only in color.

FIG. 1 is a schematic view of an image forming apparatus 10 incorporating a sealing assembly according to some exemplary embodiments of this disclosure.

The image forming apparatus 10 includes four process units 1Y, 1M, 1C, and 1Bk as image forming units. A developing device 4 is provided in each of the process units 1. The process units 1Y, 1C, 1M, and 1Bk contain yellow, magenta, cyan, and black toner, respectively, corresponding to decomposed color components of full-color images and have a similar configuration except the color of toner contained therein.

Specifically, each of the process units 1Y, 1C, 1M, and 1Bk includes a photoreceptor 52 serving as an image carrier, a charging roller 55 serving as a charging device to charge a surface of the photoreceptor 52, the developing device 4 to form a toner image on the photoreceptor 52, and a cleaning blade 54 to clean the surface of the photoreceptor 52.

Each of the process units 1Y, 1C, 1M, and 1Bk is configured to be a single unit removably mountable relative to the image forming apparatus 10. Although the process units 1Y, 1C, 1M and 1Bk are described in that order, the order is not limited thereto and may be any order.

Developer for used in the image forming apparatus 10 is nonmagnetic one-component toner serving as nonmagnetic one-component developer, and may be polymerized toner including uniform, globular toner particles having a small particle diameter. Such polymerized toner forms a reliable lubricant coated layer on the surface of the photoreceptor 52, thereby stabilizing behavior of a blade member to improve cleaning performance.

In addition, an amount of residual toner remaining on the photoreceptor 52 without being scraped off from the blade member can be significantly reduced. As a result, developing properties and transfer performance are improved to form an image having high quality. Alternatively, crushed toner may be used as developer.

Toner cartridges 50 filled with toner of the colors Y, C, M, and Bk are provided in an upper portion of the image forming apparatus 10. Toner contained in the corresponding toner cartridge 50 is conveyed to a toner container 51 included in the corresponding developing device 4 via a toner supply assembly.

An exposure device 56 is provided below each of the process units 1Y, 1C, 1M, and 1Bk to expose the surface of the corresponding photoreceptor 52. Laser light is emitted by each of the exposure devices 56 to the corresponding photoreceptor 52. A transfer device 9 is provided below the process units 1Y, 1C, 1M, and 1Bk.

The transfer device 9 includes an intermediate transfer belt 11 that can be, for example, an endless belt onto and from which an image is transferred. The intermediate transfer belt 11 is stretched around a driving roller 12 and a tension roller 13. As the driving roller 12 rotates, the intermediate transfer belt 11 rotates in a direction indicated by an arrow A illustrated in FIG. 1.

Four primary transfer rollers 53 serving as primary transfer devices are disposed opposite the respective photoreceptors 52 via the intermediate transfer belt 11. The primary transfer rollers 53 are conductive elastic rollers, and are disposed so as to contact a back surface of the intermediate transfer belt 11 while being pressed against the respective photoreceptors 52.

Each of the primary transfer rollers 53 receives a constant current bias serving as a primary transfer bias. A primary transfer nip is formed at a position at which the intermediate transfer belt 11 is interposed between each of the primary transfer rollers 53 and the corresponding photoreceptor 52.

In addition, a secondary transfer roller 17 serving as a secondary transfer device contacts an outer circumferential surface of the intermediate transfer belt 11 at a right end portion of the intermediate transfer belt 11 in FIG. 1. A secondary transfer nip is formed at a position at which the secondary transfer roller 17 faces the driving roller 12 with the intermediate transfer belt 11 interposed therebetween.

A power source for a secondary transfer bias is connected to the driving roller 12. Applying a voltage having the same polarity as a polarity of toner to the driving roller 12 causes a voltage that allows the toner to move from the intermediate transfer belt 11 to a transfer sheet P, thereby transferring a toner image onto the transfer sheet P.

Alternatively, the secondary transfer roller 17 may be a conductive elastic roller. The power source for the secondary transfer bias may be connected to the secondary transfer roller 17 to apply a transfer bias to the secondary transfer roller 17, thereby secondarily transferring the toner image formed on the intermediate transfer belt 11 onto the transfer sheet P. Alternatively, two power sources for transfer biases may be provided. In such a case, one power source may be connected to the driving roller 12 and the other power source may be connected to the secondary transfer roller 17.

A belt cleaning blade 18 is disposed near the driving roller 12 to clean a front surface of the intermediate transfer belt 11. A tip of the belt cleaning blade 18 contacts the intermediate transfer belt 11 in a direction opposite a direction of rotation of the intermediate transfer belt 11. Untransferred residual toner scraped off from the intermediate transfer belt 18 by the tip of the cleaning blade 18 is conveyed to a waste toner container 15 provided below the intermediate transfer belt 11.

A toner sensor 16 is disposed so as to face an outer circumferential surface of the tension roller 13 that is positioned at a left end portion of the intermediate transfer belt 11 in FIG. 1. The toner sensor 16 detects a density of the toner transferred onto the intermediate transfer belt 11 from the photoreceptors 52.

In other words, predetermined toner patches are developed on each of the photoreceptors 52. The predetermined toner patches thus developed are transferred onto the intermediate transfer belt 18. The toner patches thus transferred are then radiated with infrared light emitted by a light-emitting element included in the toner sensor 16. A light-receiving element included in the toner sensor 16 receives light specularly reflected from each toner patch at a reflection angle equal to an incidence angle to detect an amount of toner attached to each toner patch.

According to the result thus detected, an amount of toner supply is controlled. In addition, γ characteristics upon development is calculated based on a relation between an amount of toner attached to each of multiple toner patches having different densities prepared in a phased manner and a surface potential detected by a voltage sensor to control a grid voltage, a development bias, and laser diode power, thereby obtaining a desired amount of attached toner.

A sheet feed tray 19 and a pair of sheet feed rollers 20 are provided in a lower portion of the image forming apparatus 10. The sheet feed tray 19 accommodates a transfer sheet P as a recording medium. The pair of sheet feed roller 20 conveys the transfer sheet P from the sheet feed tray 19. In addition, a conveyance path R is formed inside the image forming apparatus 10 to guide the transfer sheet P upward from the sheet feed tray 19.

A pair of timing rollers 21 is disposed, along the conveyance path R, between the pair of sheet feed rollers 20 and the secondary transfer roller 17 facing the driving roller 12 to convey the transfer sheet P at a right time. A pair of timing rollers 21 is disposed with the conveyance path R interposed between the timing rollers 21 between the above-described two positions to convey the transfer sheet P at a right time. A fixing device 22 is disposed above the secondary transfer roller 17 to fix an image onto the transfer sheet P. Further, above the fixing device 22, a pair of discharging rollers 24 is disposed to discharge the transfer sheet P to a sheet stacking part 23 that is a recessed portion of an upper surface of the image forming apparatus 10.

(Operation of Image Forming Apparatus)

Referring to FIG. 1, basic operation of the image forming apparatus 10 is described below.

When image formation is started, the photoreceptors 52 included in the respective process units 1Y, 1C, 1M and 1Bk are rotatively driven by a driving device clockwise in FIG. 1, and the changing rollers 55 uniformly charge the surfaces of the photoreceptors 52 to a predetermined polarity.

Then, the exposure devices 56 direct laser light onto the charged surfaces of the respective photoreceptors 52 to form electrostatic latent images on the respective photoreceptors 52. More specifically, the exposure devices 56 direct the laser light according to single color data, namely, yellow, cyan, magenta, and black color data, respectively, decomposed from desired full-color image data to the surfaces of the photoreceptors 52. The electrostatic latent images formed on the photoreceptors 52 are developed into toner images with toner supplied by the respective developing devices 4.

As the driving roller 12 around which the intermediate transfer belt 11 is stretched under predetermined tension rotates, the intermediate transfer belt 11 rotates in a direction indicated by the arrow A illustrated in FIG. 1. A constant voltage or a voltage controlled to flow a constant current having a polarity opposite the polarity of toner is applied to each of the primary transfer rollers 53. Thus, transfer electrical fields are formed in the primary transfer nips between the primary transfer rollers 53 and the photoreceptors 52.

The transfer electrical fields formed in the primary transfer nips transfer the toner images formed on the photoreceptors 52 included in the process units 1Y, 1C, 1M, and 1Bk, respectively, and superimpose the toner images one atop another on the intermediate transfer belt 11. Thus, a full-color toner image is formed on the intermediate transfer belt 11. After transfer of the full-color toner image, the cleaning blades 54 remove toner remaining on the surfaces of the photoreceptors 52.

In addition, when the image formation is started, the pair of sheet feed rollers 20 rotate, thereby conveying the transfer sheet P from the sheet feed tray 19 to the conveyance path R. The pair of timing rollers 21 temporarily stops the transfer sheet P thus conveyed to the conveyance path R. Thereafter, the pair of timing rollers 21 is driven again such that the transfer sheet P is conveyed to the secondary transfer nip formed between the secondary transfer roller 17 and the intermediate transfer belt 11 in synchronization with the full-color toner image formed on the intermediate transfer belt 11.

The transfer voltage having a polarity opposite a polarity of the toner image on the intermediate transfer belt 11 is applied to the secondary transfer roller 17, and thus the transfer electrical field is formed in the secondary transfer nip. The transfer electrical field formed in the secondary transfer nip transfers the full-color toner image from the intermediate transfer belt 11 onto the transfer sheet p at a time upon arrival of the transfer sheet P and the full-color toner image on the intermediate transfer belt 11.

The cleaning blade 18 removes toner remaining on the intermediate transfer belt 11 after secondary transfer. The transfer sheet P bearing the full-color toner image thereon is then conveyed to the fixing device 22. The fixing device 22 fixes the full-color toner image onto the transfer sheet P under heat and pressure. Thereafter, the pair of discharging rollers 24 discharges the transfer sheet P to the sheet stacking part 23.

Although the description above concerns full-color image formation, alternatively, the image forming apparatus 10 can form single-color images, bicolor images, or three-color images using one, two, or three of the four process units 1.

(Process Units)

Figure 2:
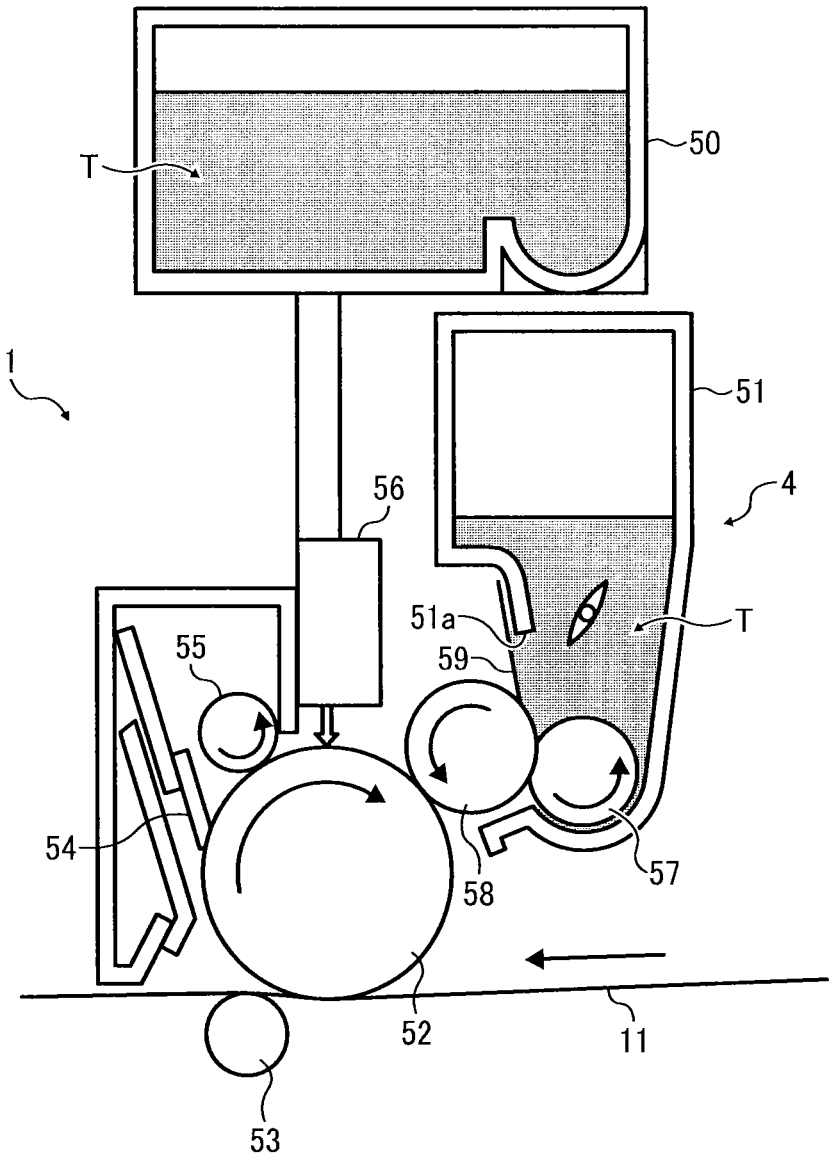
FIG. 2 is a schematic view of a process unit used in the image forming apparatus of FIG. 1 according to an exemplary embodiment of this disclosure.

A description is now given of the process units 1 in detail with reference to FIG. 2.

FIG. 2 is an enlarged view of a process unit 1 illustrated in FIG. 1.

In the process unit 1 as illustrated in FIG. 2, a charging roller 55 and an exposure device 56 are arranged on a left side of a toner container 51 of a developing device 4. A toner cartridge 50 is disposed above the toner container 51. A developing roller 58 serving as a first rotator and a supply roller 57 serving as a second rotator are disposed in a lower portion of the toner container 51. The supply roller 57 is arranged in parallel with the developing roller 58. In addition, a photoreceptor 52 is disposed facing the charging roller 55, the exposure device 56 and the developing roller 58.

The supply roller 57 and the developing roller 58 are connected to bias applying units. A bias voltage of, for example, −100V is applied to the developing roller 58, and a bias voltage of, for example, −300V is applied to the supply roller 57.

An outer circumferential surface of the photoreceptor 52 is negatively and uniformly charged by the charging roller 55 at a predetermined potential. Then, the outer circumferential surface of the photoreceptor 52 receives laser light emitted by the exposure device 56, and thus a desired electrostatic latent image is formed thereon. Toner accumulated in the toner container 51 is conveyed to the developing roller 58 via the supply roller 57. A regulation blade 59 forms and maintains a layer of the toner attached to an outer circumferential surface of the developing roller 58 in a uniform thickness. The toner layer thus maintained in a uniform thickness adheres to the electrostatic latent image formed on the photoreceptor 52 by a potential difference between the developing roller 58 and the photoreceptor 52. The toner layer thus adhering to the electrostatic latent image is then primarily transferred onto the intermediate transfer belt 11.

The charging roller 55 may be disposed so as to contact the photoreceptor 52. Alternatively, the charging roller 55 may be disposed opposite the photoreceptor 52 with a small gap therebetween. The charging roller 55 disposed so as to contact the photoreceptor 52 suppresses ozone generation. The charging roller 55 disposed so as not to contact the photoreceptor 52 is not stained with toner, thereby improving durability thereof.

The charging roller 55 disposed so as not to contact the photoreceptor 52 suppresses an adverse effect such as variation of charging potential caused by variation of the small gap. Accordingly, the photoreceptor 52 is uniformly charged and the charging potential of the photoreceptor 52 is stabilized, thereby achieving higher image quality. The charging roller 55 may charge the photoreceptor 52 by superimposing an alternating-current voltage on a direct current voltage, allowing a sufficient charging current to flow into the photoreceptor 52 even when the charging roller 55 and the photoreceptor 52 are not in contact with each other. It is to be noted that a charging cleaning roller may be disposed so as to interpose the charging roller 55 between the charging cleaning roller and the photoreceptor 52.

When image formation is started in the process unit 1 illustrated in FIG. 2, the photoreceptor 52 is rotatively driven clockwise in FIG. 2. At this time, the charging roller 55 to which a charging voltage is applied charges the photoreceptor 52 at a predetermined positive potential. The photoreceptor 52 thus charged receives laser light emitted by the exposure device 56 as illustrated in FIG. 2, and thus the electrostatic latent image is formed thereon. The electrostatic latent image thus formed on the photoreceptor 52 moves to a development nip at which the electrostatic latent image faces the developing roller 58. The toner is supplied from the developing roller 58 to the electrostatic latent image at the development nip.

Specifically, the developer carried by the developing roller 58 that rotates counterclockwise in FIG. 2 is regulated by the regulation blade 59 so that the developer has a predetermined thickness. The developer thus regulated is then conveyed to the development nip formed between the developing roller 58 and the photoreceptor 52. At the development nip, toner particles in the developer are electrostatically moved to the electrostatic latent image formed on the photoreceptor 52, thus developing the electrostatic latent image into a toner image.

Then, the toner image formed on the photoreceptor 52 moves to a bottom portion of the photoreceptor 52 to be primarily transferred from the photoreceptor 52 onto the intermediate transfer belt 11. The toner image is transferred from the photoreceptor 52 onto the intermediate transfer belt 11 at a predetermined job interval and at an appropriate time adjusted by the toner sensor 16.

After the primary transfer of the toner image, the cleaning blade 54 removes toner remaining on the surface of the photoreceptor 52. The residual toner thus removed is conveyed to the waste toner container 15. Meanwhile, a toner amount detector provided in the toner container 51 of the process unit 1 detects an amount of toner contained in the toner container 51. When the amount of toner contained in the toner container 51 is below a predetermined threshold, a predetermined amount of toner is supplied from the toner cartridge 50 to the toner container 51.

(Development Operation)

A description is now given of development operation.

The toner is conveyed from the toner container 51 of the developing device 4 to a supply nip at which the supply roller 57 and the developing roller 58 contact each other, by rotation of the toner supply roller 57 and the developing roller 58 and/or being taken into the supply roller 57 or attached to a surface of the supply roller 57. The toner thus conveyed to the supply nip contacts a surface of the developing roller 58 to be frictionally charged in the supply nip.

A voltage having the same polarity as a polarity of toner is applied to each of the supply roller 58 and the supply roller 57. A bias between the supply roller 57 and the developing roller 58 is set to satisfy a relation of $|Vd|<|Vs|$, where an absolute value $|Vs|$ of charging potential of the supply roller 57 is larger than an absolute value $|Vd|$ of charging potential of the developing roller 58, to move the charged toner to the developing roller 58. The bias thus conveys the charged toner from the supply roller 57 to the developing roller 58.

The supply roller 57 has an elastic layer including open-cell resin foam such as polyurethane foam to form the supply nip on a circumferential surface thereof and to carry the toner. In addition, the open-cell resin foam has conductivity to allow the bias to act on the supply nip, by dispersion of a conductive agent such as carbon black particles in the open-cell resin foam, for example. A volume resistance of the elastic layer is preferably about from $10^2$ Ωcm to $10^5$ Ωcm.

The developing roller 58 has an elastic layer including a rubber material such as urethane, silicon, or epichlorohydrin to form the development nip and the supply nip on a circumferential surface thereof and to charge the toner. The elastic layer is adjusted so as to have a volume resistance of $10^5$ Ωcm to $10^7$ Ωcm by dispersion of a conductive agent in the elastic layer, for example. The elastic layer may be configured in multiple layers by providing a coating layer on the elastic layer, for example, to adjust charging performance as necessary.

The toner conveyed from the supply roller 57 and adhering to the surface of the developing roller 58 is further conveyed to a regulation nip at which the toner contacts the regulation blade 59. The surface of the developing roller 58 preferably has a roughness of Ra 0.2 μm to 2.0 μm to hold a requisite amount of toner on the surface of the developing roller 58.

The toner on the developing roller 58 is adjusted to have a relatively small thickness or amount necessary for development when passing through the regulation nip. The toner on the developing roller 58 is also frictionally charged, when passing through the regulation nip, and charge is added to the toner when a bias is applied to the developing roller 58 as in the supply nip. Thus, the toner on the developing roller 58 is charged.

The regulation blade 59 is, for example, a board-shaped spring as illustrated in FIG. 2 and includes a metal material such as SUS304CSP, SUS301CSP or phosphor bronze. A free end of the regulation blade 59 contacts the surface of the developing roller 58 with a pressure force of 10 N/m to 100 N/m.

The thin toner layer on the developing roller 58 passing through the regulation blade 59 from the toner container 51 of the developing device 4 is conveyed to the development nip at which the thin toner layer contacts the photoreceptor 52. The surface of the photoreceptor 52 is uniformly charged by the charging roller 55, and then the charged surface of the photoreceptor 52 receives laser light emitted by the exposure device 56 on the basis of the image data. Thus, the electrostatic latent image is formed thereon. The electrostatic latent image is conveyed to the development nip by rotation of the developing roller 58. At the development nip, the toner on the developing roller 58 is electrostatically attached onto the photoreceptor 52, thus developing the electrostatic latent image into a toner image.

(Sealing Assembly)

Figure 3A:
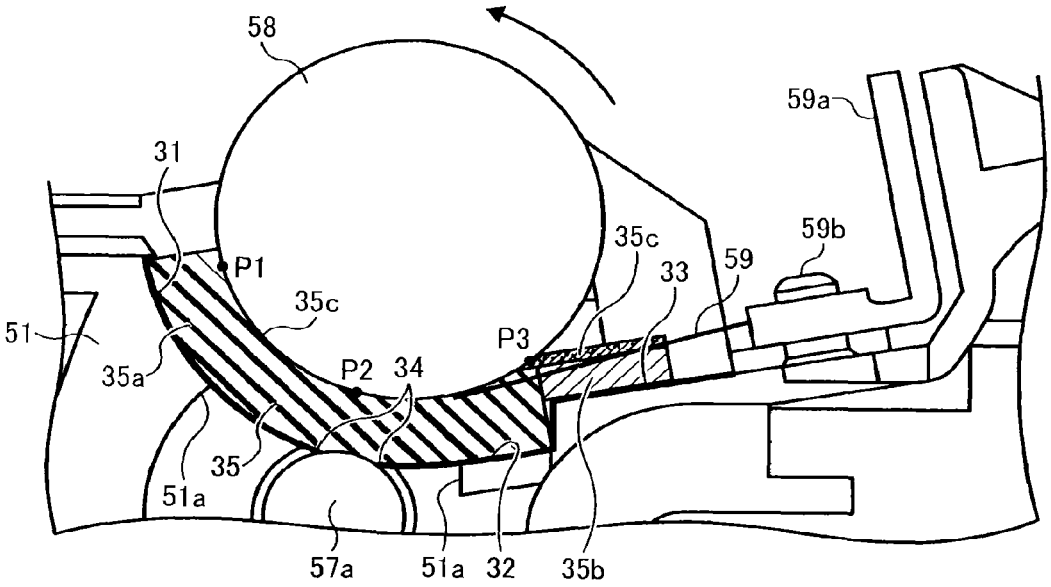
FIG. 3A is a cross-sectional view of a sealing assembly according to a first exemplary embodiment.

A description is now given of a sealing assembly incorporated in the developing device 4. FIGS. 3A through 3D illustrate a sealing assembly according to a first exemplary embodiment. FIG. 3A is a cross-sectional view of the sealing assembly. An arrangement of the sealing assembly illustrated in FIG. 3A corresponds to an arrangement in which the sealing assembly of FIG. 2 is rotated 90 degrees clockwise.

Figure 3B:
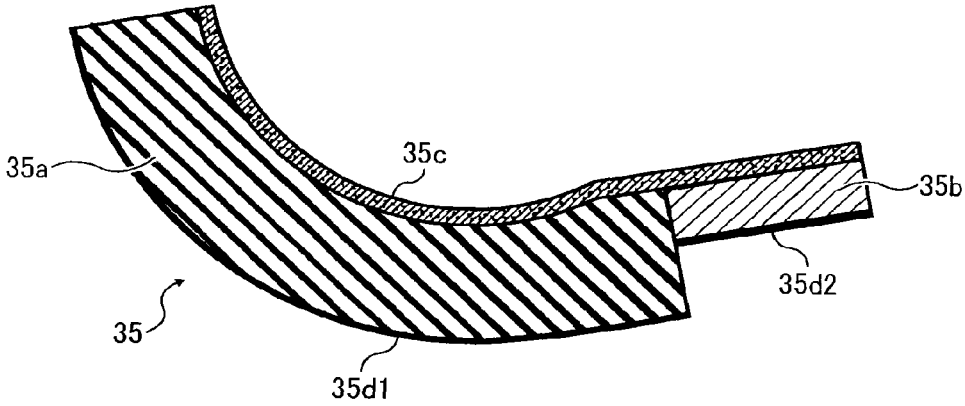
FIG. 3B is a cross-sectional view of a sealing member of FIG. 3A.
Figure 3C:
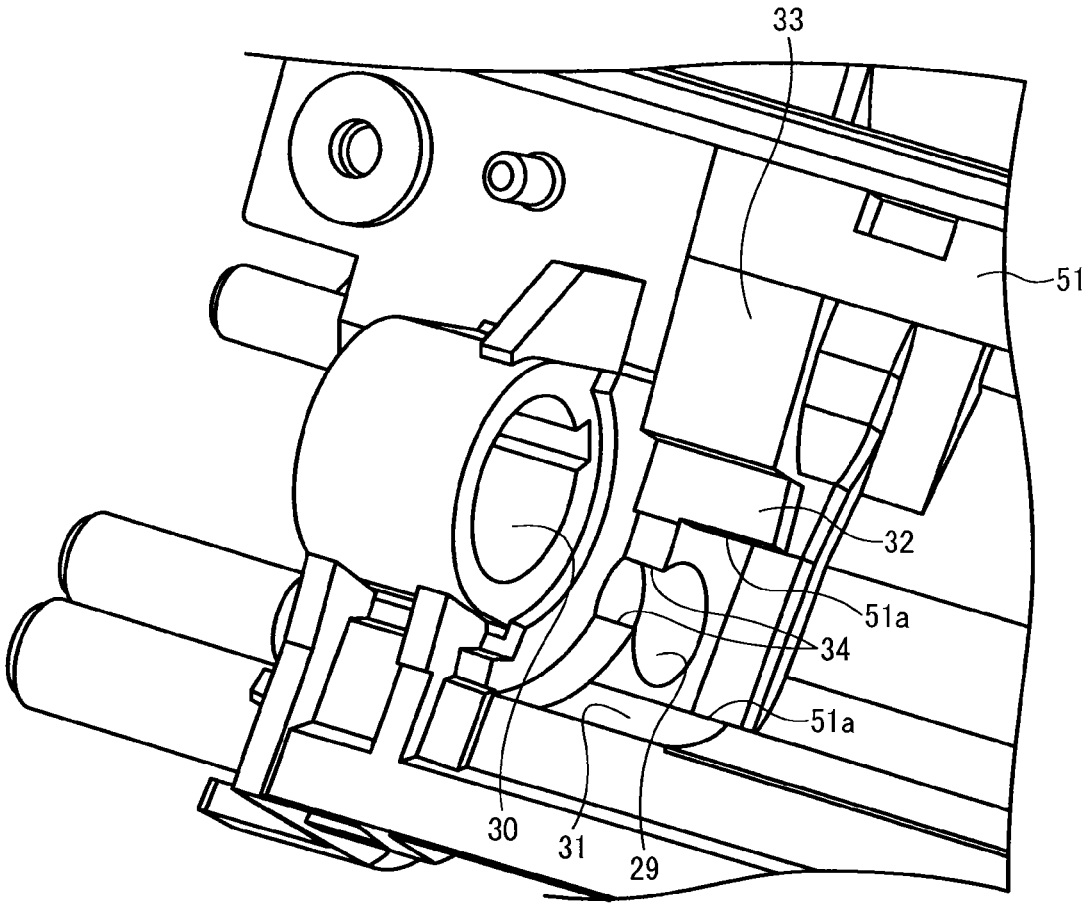
FIG. 3C is a partial perspective view of a toner container with a rotator and the sealing member of FIG. 3A removed.
Figure 3D:
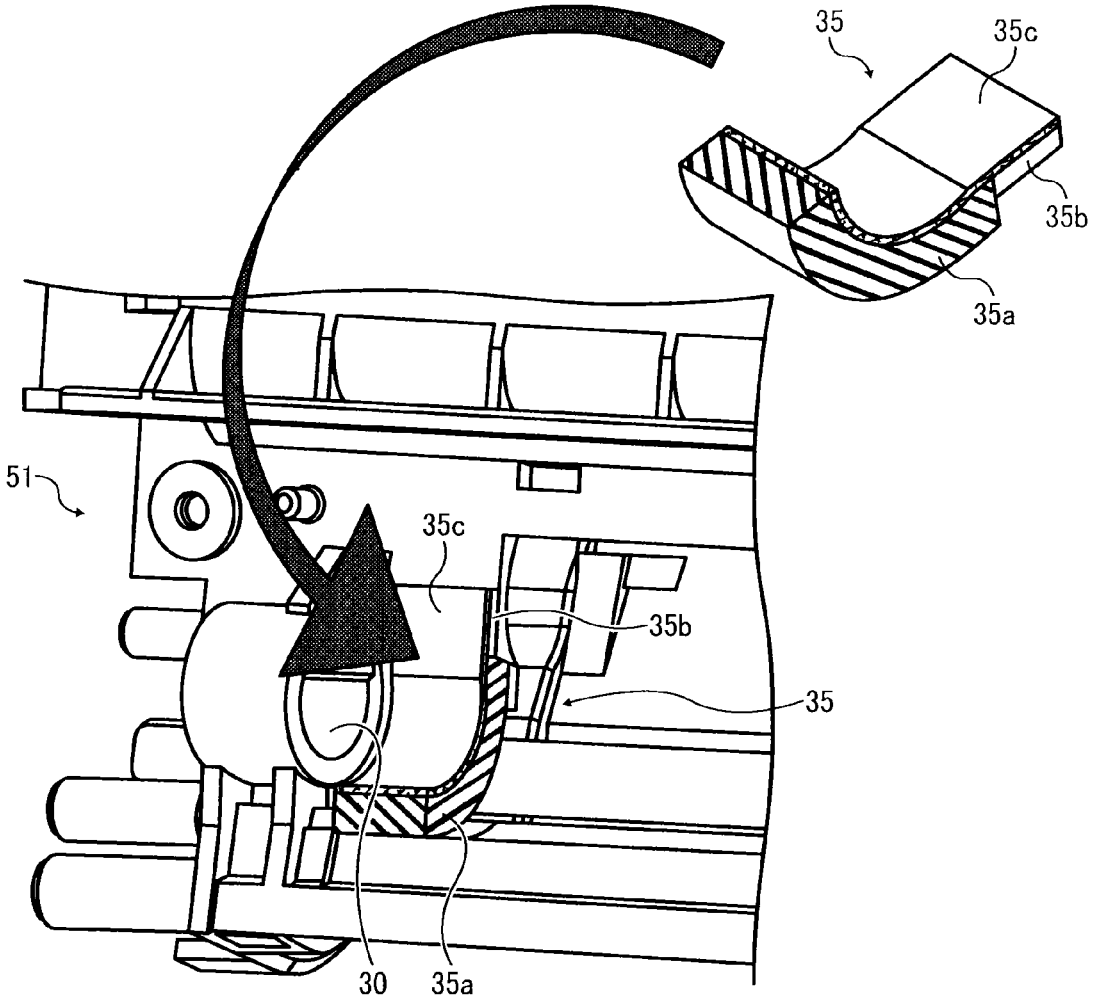
FIG. 3D is a partial perspective diagram of the toner container with the sealing member of FIG. 3A mounted and the rotator of FIG. 3A removed.

FIG. 3B illustrates a sealing member 35, which is also referred to as a side seal, used in the sealing assembly. The sealing member 35 slidably contacts a circumferential surface of each end in an axial direction of a developing roller 58 to seal a gap between the developing roller 58 and other components. As illustrated in FIG. 3D, the sealing member 35 is attached and fixed to a toner container 51 illustrated in FIG. 3B by using double-sided tapes 35*d*1 and 35*d*2. It is to be noted that a bearing hole 30 and a bearing hole 29 are provided as illustrated in FIG. 3C to support a shaft of the developing roller 58 serving as a first rotator and a shaft of the supply roller 57 serving as a second rotator, respectively.

As illustrated in FIG. 3A, the toner container 51 has an opening 51*a* through which powder is conveyed. The opening 51*a* extends in a vertical direction in the surface of the sheet of paper on which FIG. 3A is drawn. The developing roller 58 is disposed so as to seal the opening 51*a* from outside. In other words, the developing roller 58 is disposed in a direction so that an axis of the developing roller 58 crosses an interval between both ends of the opening 51*a*. Bearing surfaces 31, 32, and 33 are disposed at each end of the opening 51*a*. The sealing member 35 is attached to the bearing surfaces 31, 32, and 33.

The bearing surface 31 is disposed on an upstream side (entry side) in a direction of rotation of the developing roller 58. On the other hand, the bearing surfaces 32 and 33 are disposed on a downstream side (exit side) in the direction of rotation of the developing roller 58. A notch 34 is formed between the bearing surface 31 and the bearing surface 32. It is to be noted that, in the following description, the upstream side in the direction of rotation of the developing roller 58 is referred to as entry side, and the downstream side in the direction of rotation of the developing roller 58 is referred to as exit side, as necessary.

The bearing surface 31 on the entry side is formed in an arc shape with a predetermined interval between the circumferential surface of the developing roller 58 and the bearing surface 31. Each of the bearing surfaces 32 and 33 on the exit side is formed in a planar shape extending in a tangential direction of the surface of the developing roller 58. The inner bearing surface 32 is shorter than the outer bearing surface 33. A distance between the developing roller 58 and the shorter, inner bearing surface 32 is longer than a distance between developing roller 58 and the longer, outer bearing surface 33. The two bearing surfaces 32 and 33 are connected to each other in an uneven parallel manner, thereby preventing a positional shift of the sealing member 35 caused by rotation of the developing roller 58.

A bracket 59*a* of the regulation blade 59 is attached to the toner container 51 via a screw 59*b* in an extending direction of the outer bearing surface 33.

The sealing member 35 has an elastic member 35*a* and an elastic member 35*b*. The elastic member 35*a* is formed in an arc shape and has a predetermined thickness. The elastic member 35*b* is disposed adjacent to the elastic member 35*a* and is thinner than the elastic member 35*a*. Specifically, the elastic member 35*b* is about half a thickness of the elastic member 35*a*. The sealing member 35 also has a sealing base 35*c* and the double-sided tapes 35*d*1 and 35*d*2. The sealing base 35*c* is disposed on an inner slide surface side of the sealing member 35, smoothly and seamlessly extending on inner circumferential surfaces of the elastic member 35*a* and the elastic member 35*b*. The double-sided tapes 35*d*1 and 35*d*2 are disposed on outer fixed surfaces (bottom surfaces in FIG. 3B) of the elastic members 35*a* and 35*b*, respectively. The two elastic members 35*a* and 35*b* may be different from each other not only in thickness, but also in material thereof as illustrated in FIG. 4. For example, both the thickness and hardness of the elastic members 35*a* and 35*b* may be different from each other.

An outer surface of an end on the entry side of the thicker elastic member 35*a* is attached to the bearing surface 31 positioned on the entry side. An outer surface of an end on the exit side of the thicker elastic member 35*a* is attached to the bearing surface 32 positioned on the exit side. An entire outer surface of the thinner elastic member 35*b* is attached to the bearing surface 33 positioned on the exit side. An unfixed portion without any supporting bearing surfaces is formed in an outer surface of an intermediate portion between the end on the entry side of the thicker elastic member 35*a* and the other end on the exit side of the thicker elastic member 35*a*. The unfixed position may be the notch 34 or may be a member softer than the elastic member 35*a*.

An inner surface of the end on the entry side of the thicker elastic member 35*a* contacts the surface of the developing roller 58 via the sealing base 35*c* with a predetermined contact pressure (first pressure P1). The regulation blade 59 is positioned on top of the thinner elastic member 35*b*. Both ends of the regulation blade 59 are positioned within a width of the thinner elastic member 35*b*. A portion of the elastic member 35*b* corresponding to an outside of the each end of the regulation blade 59 contacts the surface of the developing roller 58 via the sealing base 35*c* with a predetermined contact pressure (third pressure P3).

The outer surface of the intermediate portion between the both ends on the entry and exit sides of the thicker elastic member 35*a* has a portion that is not attached to the toner container 51. The outer surface of the intermediate portion is exposed in the toner container 51. A part of the outer surface of the intermediate portion thus exposed contacts a surface of a shaft core of a supply roller shaft 57*a*. In other words, the outer surface of the intermediate portion of the elastic member 35*a* is supported by the supply roller shaft 57*a* instead of the toner container 51. Accordingly, the supply roller shaft 57*a* maintains a predetermined compression amount of the intermediate portion of the elastic member 35*a*, thereby ensuring that a predetermined contact pressure (second pressure P2) is created between a portion of the sealing base 35*c* contacting an inner surface of the intermediate portion and the surface of the developing roller 58.

The toner may leak from a position between the surface of the developing roller 58 and each of the ends of the sealing member 35 positioned on the upstream and downstream sides in the direction of rotation of the developing roller 58. In other words, the toner tends to leak from a position between the surface of the developing roller 58 and each of the ends on the entry and exit sides of the sealing member 35. The toner may also leak therefrom when receiving an impact of, for example, vibration or falling of the image forming apparatus 10. However, reliable sealing of both the inner and outer surfaces of the sealing member 35 prevents the toner from leaking.

On the other hand, the toner is unlikely to leak, in the axial direction of the developing roller 58, from a position between the surface of the developing roller 58 and the intermediate portion between the ends of the sealing member 35 positioned on the upstream and downstream sides in the direction of rotation of the developing roller 58, respectively. The intermediate portion of the sealing member 35 slidably contacts a wide rage of the surface of the developing roller 58. Therefore, it is advantageous to reduce contact pressure for heating and torque reduction rather than to increase contact pressure for higher sealing performance.

As described above, in the first exemplary embodiment, the outer surfaces of both ends in a circumferential direction of the sealing member 35 are attached to the toner container 51 with the double-sided tapes 35*d*1 and 35*d*2. Accordingly, the toner does not leak therefrom. In addition, at the end on the entry side of the sealing member 35, that is, the end on the upstream side in the circumferential direction of the sealing member 35, the sealing base 35*c* contacts the surface of the developing roller 58 with the first contact pressure P1. At the end on the exit side of the sealing member 35, that is, the end on the downstream side in the circumferential direction of the sealing member 35, the sealing base 35*c* contacts the surface of the developing roller 58 with the third contact pressure P3. The contact pressure P3 is created at a contact position between a tip of the regulation blade 59 and the surface of the developing roller 58.

In the first exemplary embodiment, pressure relations of P2<P1 and P2<P3 are satisfied. In other words, the contact pressure P2 created at a contact position between the surface of the developing roller 58 and the intermediate portion in the circumferential direction of the sealing member 35 is smaller than the contact pressure P1 and the contact pressure P3 created at contact positions between the surface of the developing roller 58 and the ends of the sealing member 35. Thus, the sealing member 35 contacts the surface of the developing roller 58 with the higher pressure P1 and pressure P3 at the end on the entry side and the end on the exit side, respectively, from which the toner is likely to leak, and with the lower pressure P2 at the intermediate portion, from which the toner is unlikely to leak, to avoid increase in torque. The pressure P1 on the entry side and the pressure P3 on the exit side may be the same pressure. In other words, the third pressure may be alternatively referred to as the first pressure. The toner may leak from the position between the surface of the developing roller 58 and the end on the exit side of the sealing member 35 easier than the position between the surface of the developing roller 58 and the end on the entry side of the sealing member 35. Accordingly, the pressure relation of P1<P3 may be satisfied.

A typical sealing member such as a compound material of felt having a thickness of 1 mm and sponge having a thickness of 1 mm is fixed to bearing surfaces of a toner container with, for example, a double-sided tape and contacts a developing roller to be compressed to a thickness of 1 mm from the original thickness of 2 mm. Thus, the sealing member is deformed under high pressure to prevent the toner from leaking. Therefore, a temperature at each end of the developing roller is increased.

In at least one exemplary embodiment, the both ends in the circumferential direction of the sealing member 35 such as a compound material of felt having a thickness of 1 mm and sponge having a thickness of 4 mm is fixed to the toner container 51. On the other hand, the outer surface of the intermediate portion in the circumferential direction of the sealing member 35 is not fixed as a notch is formed in the bearing surface 31 of the toner container 51 at a position corresponding to the outer surface of the intermediate portion in the circumferential direction of the sealing member 35. The inner surface of the intermediate portion in the circumferential direction of the sealing member 35 contacts the surface of the developing roller 58. In addition, the intermediate portion in the circumferential direction of the sealing member 35 is apparently compressed by 3 mm from a natural thickness of 5 mm to have a thickness of 2 mm when attached to the toner container 51. Thus, compression allowance is increased.

Accordingly, the sealing member 35 softly covers the surface of the developing roller 58, thereby effectively preventing the toner from leaking under low pressure. In other words, although contact pressure created between the surface of the developing roller 58 and the sealing member 35 is half or less than contact pressure created between the surface of the developing roller 58 and the typical sealing member, an amount of deformation of the sealing member 35 is equal or larger than an amount of deformation of the typical sealing member. Accordingly, the toner is effectively prevented from leaking.

Figure 4A:
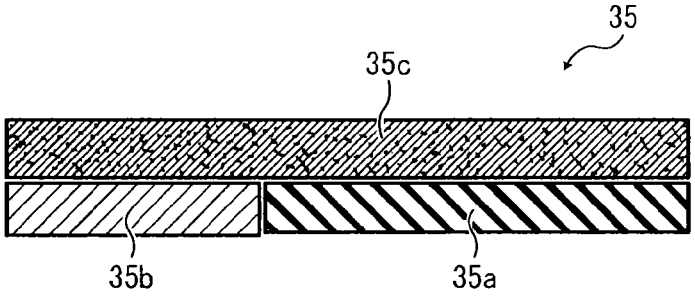
FIGS. 4A through 4C are cross-sectional views of sealing members.
Figure 4B:
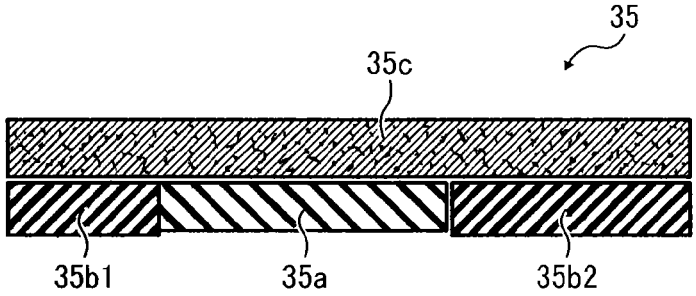
Figure 4C:
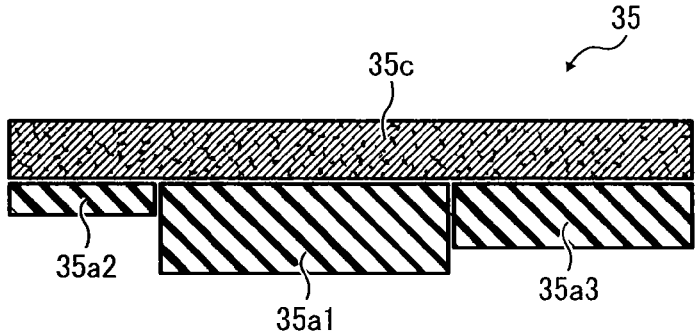

FIGS. 4A through 4C illustrate examples of the sealing member 35, each being different in kinds and/or height of the elastic members 35*a* and 35*b*, so that contact pressure created between the surface of the developing roller 58 and the both ends in the circumferential direction of the sealing member 35 is different from contact pressure created between the surface of the developing roller 58 and the intermediate portion in the circumferential direction of the sealing member 35.

In FIG. 4A, two kinds of elastic members 35*a* and 35*b* are used. Specifically, the elastic members 35*a* and 35*b* have different elastic materials. When the elastic members 35*a* and 35*b* have the same height, the elastic member 35*b* has an elastic coefficient larger than an elastic coefficient of the elastic member 35*a*. In this case, the pressure relation of P2<P1 or P2<P3 is satisfied.

In FIG. 4B, two or three kinds of elastic members 35*a*, 35*b*1, and 35*b*2 are used. Specifically, the elastic member 35*a* includes an elastic material different from an elastic material (s) included in the elastic members 35*b*1 and 35*b*2. The elastic member 35*b*1 and the elastic member 35*b*2 may be the same or may be different. In this case, a pressure relation of P2<P1 (=P3) or P2<P1<P3 is satisfied when the elastic members 35*b*1 and 35*b*2 have the same height.

In FIG. 4C, one kind of elastic members 35*a*1, 35*a*2, and 35*a*3 are used. The elastic members 35*a*1, 35*a*2, and 35*a*3 have the same elastic material, but are different in height. The elastic members 35*a*1, 35*a*2, and 35*a*3 different in height allows contact pressure of the sealing member 35 relative to the developing roller 58 to be different from contact pressure of the sealing member 35 relative to the regulation blade 59. The three elastic members 35*a*1, 35*a*2, and 35*a*3 different not only in height but in materials included therein may generate a larger difference in contact pressure.

Figure 5A:
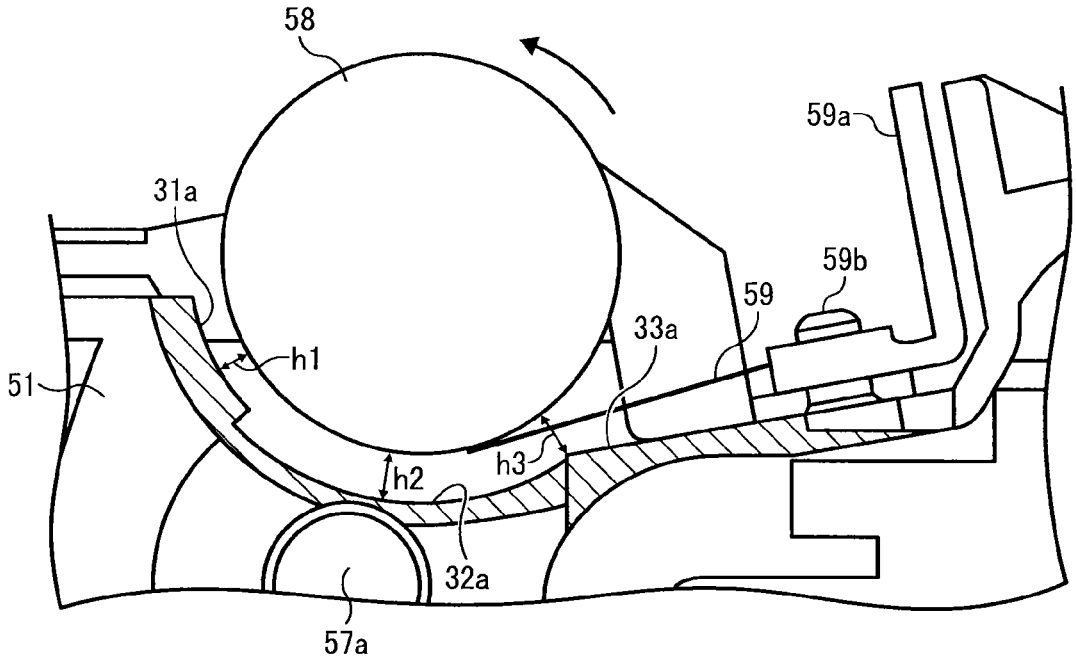
FIG. 5A is a cross-sectional view of a sealing assembly according to a second exemplary embodiment of this disclosure.
Figure 5B:
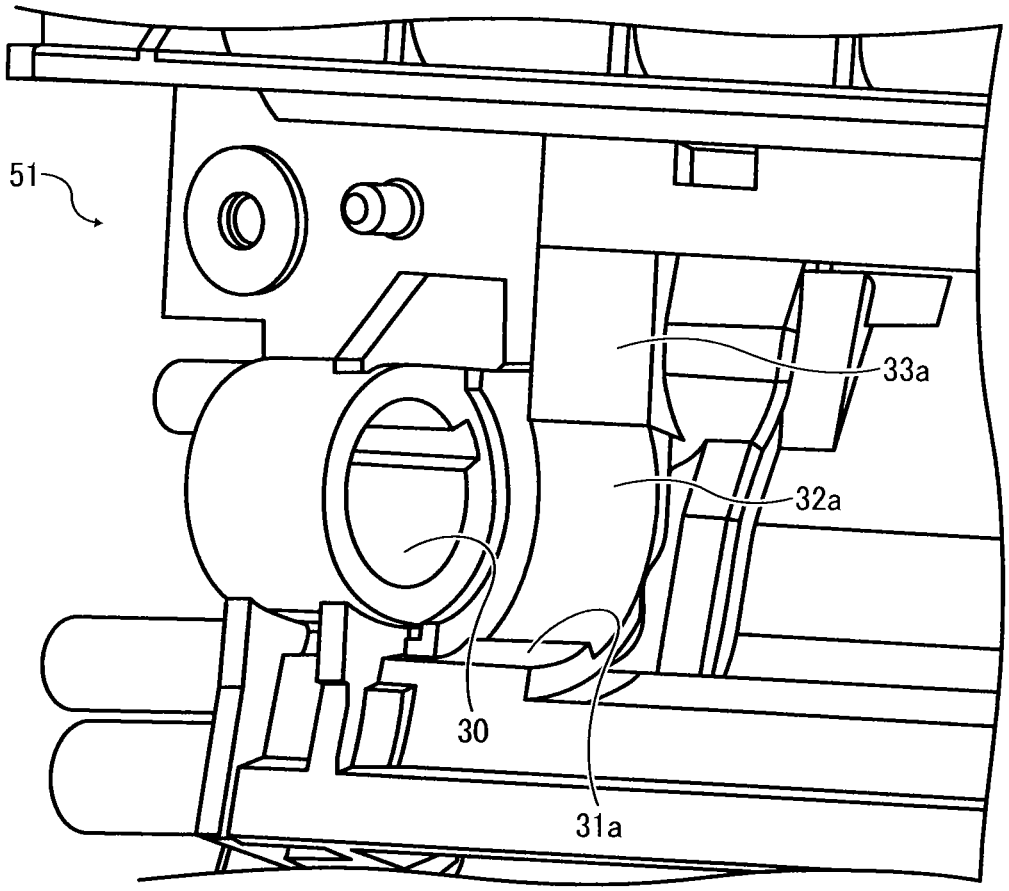
FIG. 5B is a partial perspective view of a toner container with a rotator and a sealing member of FIG. 5A removed.

FIGS. 5A and 5B illustrate a sealing assembly according to a second exemplary embodiment.

Heights from a surface of a developing roller 58 to bearing surfaces 31*a* through 33*a* are different from each other so that elastic members 35*a* and 35*b* are different in compression allowance. For example, when a sealing member 35 includes an elastic member 35*a* having a predetermined height and material (hardness) like the sealing member 335 illustrated in FIG. 9B, the above-described pressure relation of P2<P1<P3 can be achieved by satisfying a relation of h3<h1<h2, where h1 represents a height from the surface of the developing roller 58 to the bearing surface 31, h2 represents a height from the surface of the developing roller 58 to the bearing surface 32, and h3 represents a height from the surface of the developing roller 58 to the bearing surface 33.

When the sealing member 35 having the predetermined height is attached to a toner container 51 of FIGS. 5A and 5B, contact pressure created between a surface of a developing roller 58 and an intermediate portion in a circumferential direction of the sealing member 35 under which the bearing surface 32 is positioned can be set to be lower than contact pressure created between the developing roller 58 and each end of the sealing member 35. As described above, the contact pressure created between the developing roller 58 and the sealing member 35 may vary depending on contact positions between the surface of the developing roller 58 and portions in the circumferential direction of the sealing member 35 when the bearing surfaces 31 through 33 of the toner container 51 have different heights or the sealing member 35 has elastic members different in height and/or hardness.

Figure 6A:
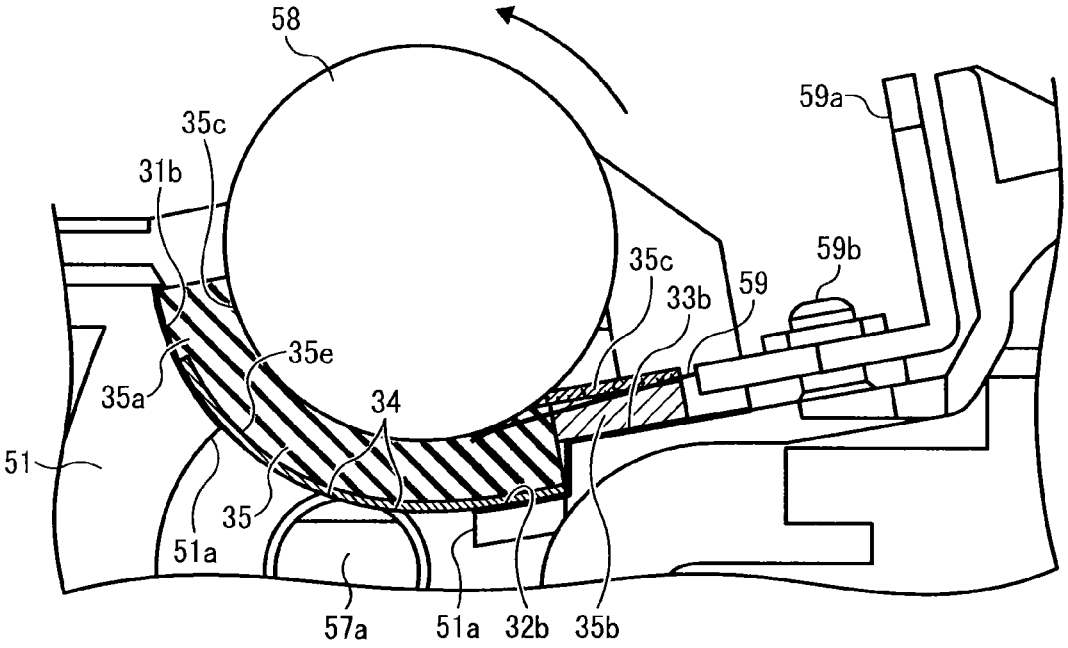
FIG. 6A is a cross-sectional view of a sealing assembly according to a third exemplary embodiment of this disclosure.
Figure 6B:
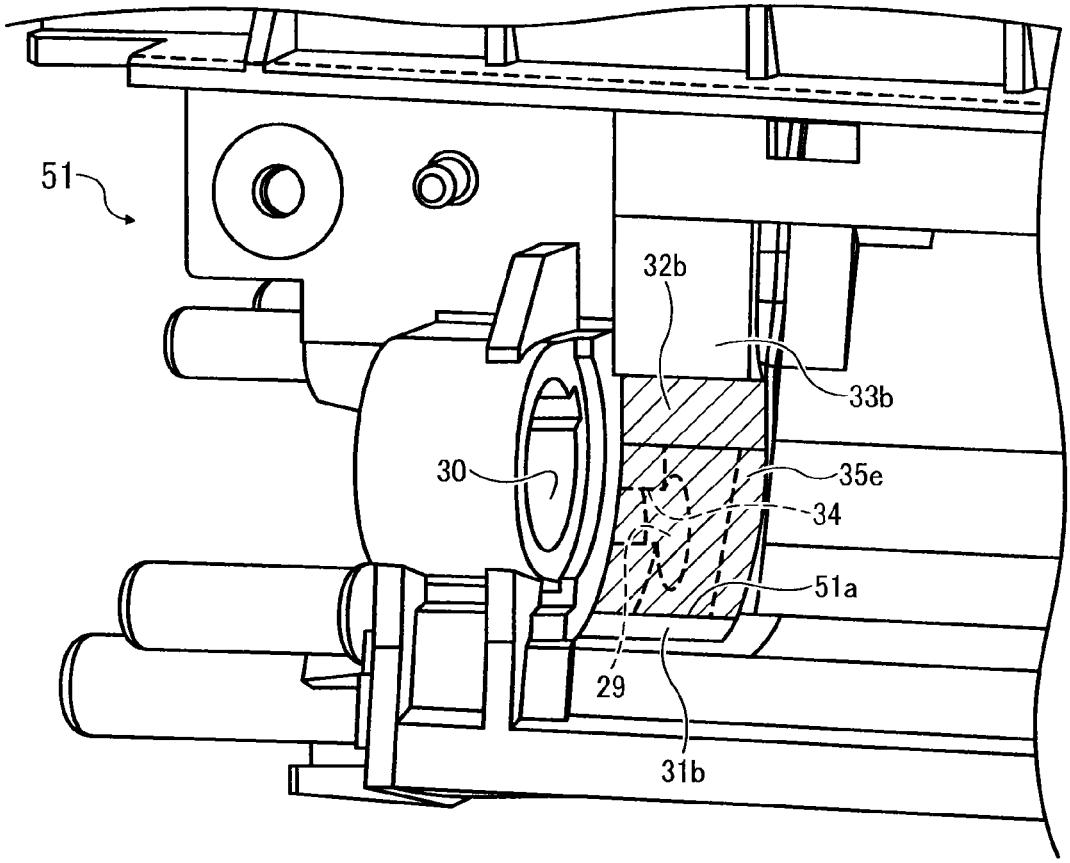
FIG. 6B is a partial perspective view of a toner container with a rotator and a sealing member of FIG. 6A removed.
Figure 6C:
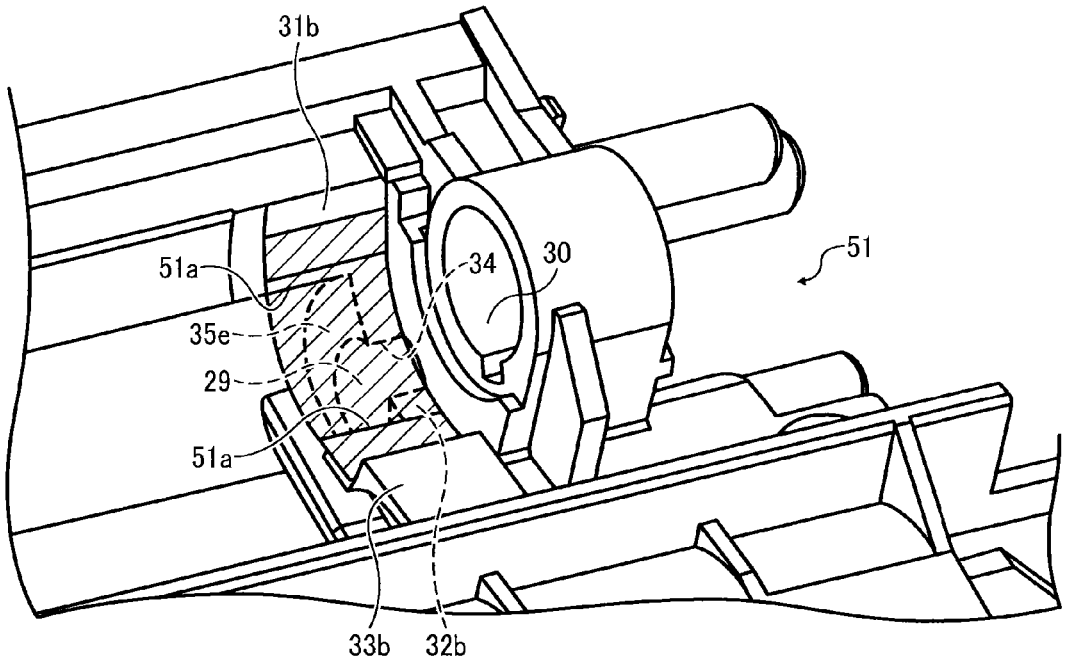
FIG. 6C is a partial perspective view of the toner container with the rotator and the sealing member of FIG. 6A removed as seen at a different angle.

FIGS. 6A through 6C illustrate a sealing assembly according to a third exemplary embodiment.

A slide film 35*e* serving as a slide member is disposed across a bearing surface 31*b* positioned on the entry side and a bearing surface 32*b* positioned on the exit side. The slide film 35*e* is a hatched portion in FIG. 6B. The slide film 35*e* prevents the sealing member 35 from wrinkling. The slide film 35*e* includes a material having excellent sliding properties and can be easily deformed into an arc shape such as a PET film having a thickness not greater than 0.1 mm.

Only an upstream end of the slide film 35*e* is attached to a downstream portion of the bearing surface 31*b* with a double-sided tape. A portion between the upstream end of the slide film 35*e*, which is attached to the bearing surface 31*b*, and a downstream end of the slide film 35*e*, which is placed to the bearing surface 32*b*, is not fixed to the toner container 51. An upstream end of an elastic member 35*a* included in the sealing member 35 is attached to, with a double-sided tape, an upstream portion of the bearing surface 31*b* to which the slide film 35*e* is not attached.

A downstream end of the elastic member 35*a* included in the sealing member 35 is slidably supported by the bearing surface 32*b* via the slide film 35*e*. An intermediate portion of the elastic member 35*a* is slidably placed on the slide film 35*e*. As illustrated in FIG. 6B, the intermediate portion of the elastic member 35*a* is positioned on a notch 34 to be supported by a surface of a shaft core of a supply roller shaft 57*a* via the slide film 35*e*. A configuration other than as described above of the sealing assembly according to the third exemplary embodiment is the same as the configuration of the sealing assembly according to the first exemplary embodiment.

Here, a description is given of the slide film 35*e*.

Figure 9A:
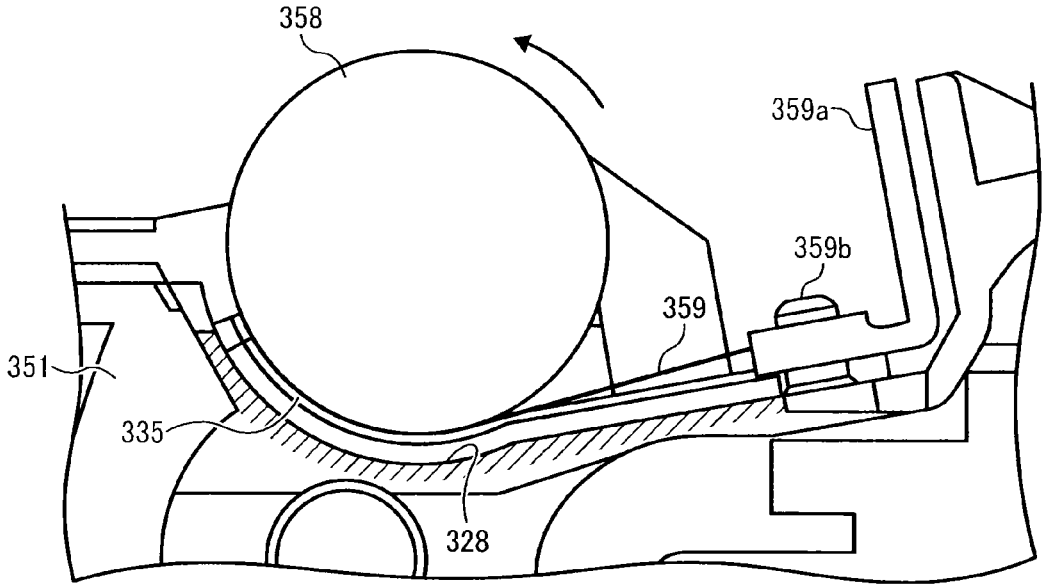
FIG. 9A RELATED ART
FIG. 9A is a cross-sectional view of a sealing assembly according to a related art.
Figure 9B:
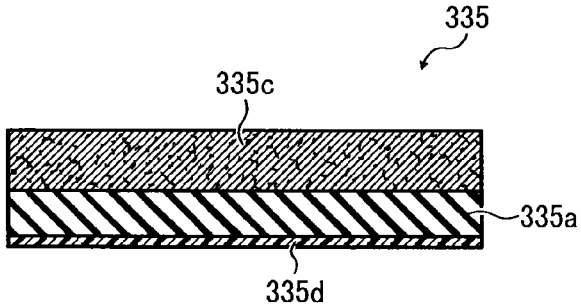
FIG. 9B RELATED ART
FIG. 9B is a cross-sectional view of a sealing member used in the sealing assembly of FIG. 9A.
Figure 9C:
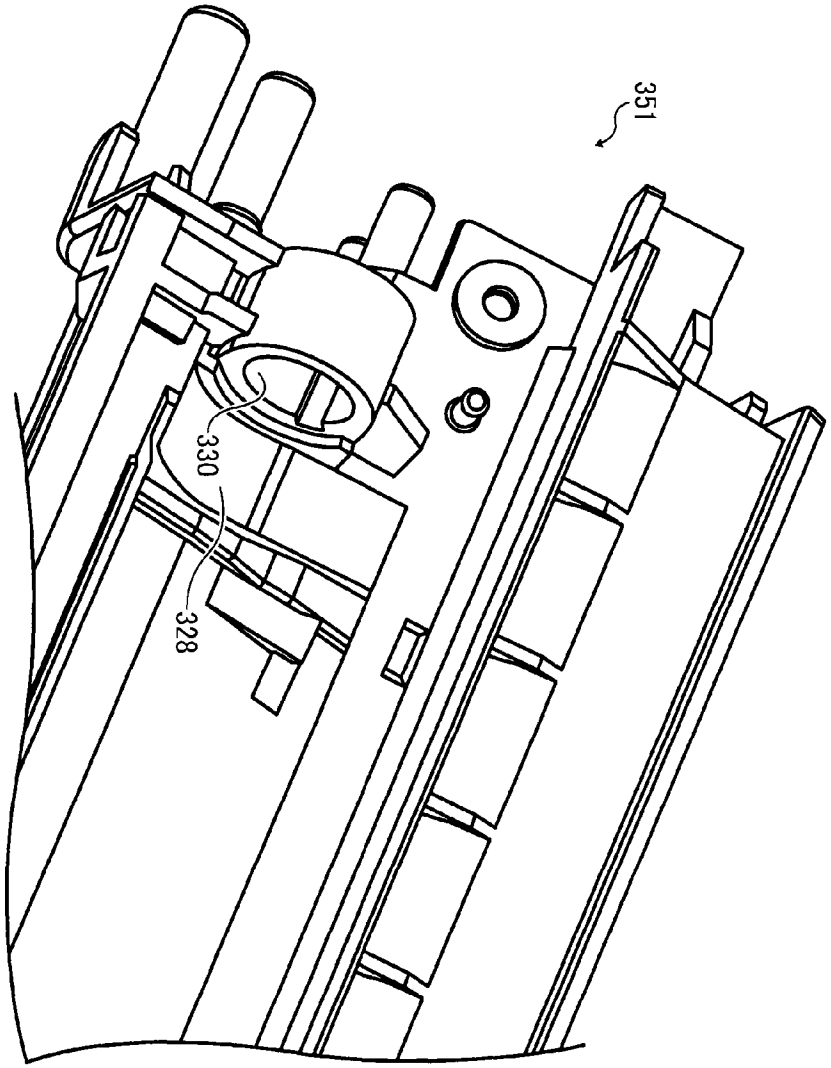
FIG. 9C RELATED ART
FIG. 9C is a partial perspective view of a toner container with a rotator and a sealing member of FIG. 9A removed.
Figure 9D:
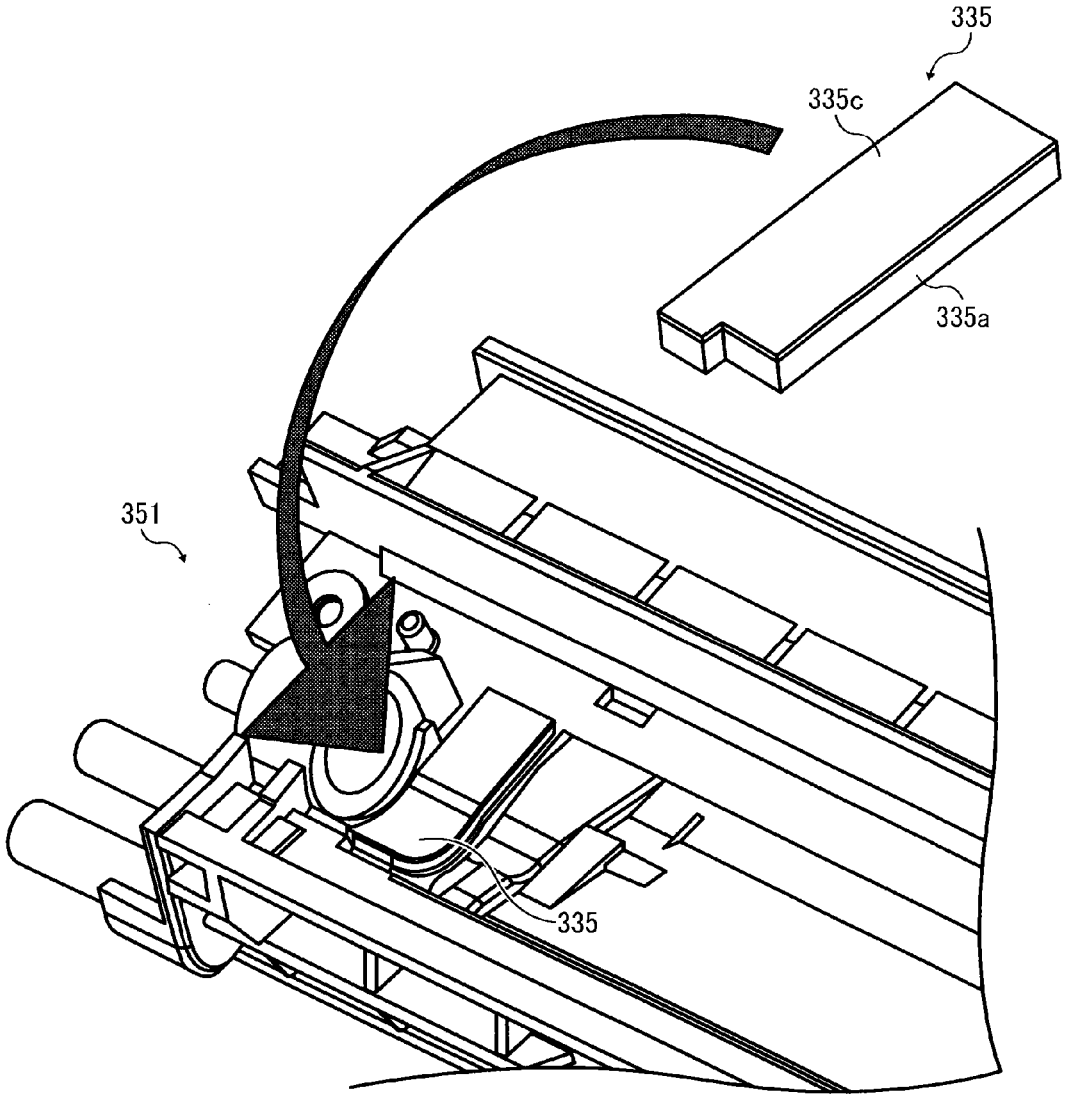
FIG. 9D RELATED ART
FIG. 9D is a partial perspective view of the toner container with the sealing member of FIG. 9A mounted and the rotator of FIG. 9A removed.

As illustrated in FIG. 9A, the surface of the developing roller 358 contacts, under high pressure, a large surface area of the sealing member 335 supported by the bearing surface 328 seamlessly extending from the entry side to the exit side. Therefore, a large frictional force is created between the developing roller 358 and the sealing member 335, causing increase in temperature at a portion at which the frictional force is created and in torque of the developing roller 358. In addition, the sealing member 335 is strongly moved from the upstream side to the downstream side, e.g., from left to right in FIG. 9A, by rotation of the developing roller 358. Consequently, the sealing member 335 may be peeled off from the bearing surface 328. Accordingly, it is necessary to fix the sealing member 335 to an entire surface of the bearing surface 328 with the double-sided tape 335*d*.

By contrast, in the first exemplary embodiment as illustrated in FIG. 3A, the sealing member 35 does not contact the developing roller 58 in a whole circumferential direction of the sealing member 35 with a uniform contact pressure. The intermediate portion in the circumferential direction of the sealing member 35 contacts the surface of the developing roller 58 with the contact pressure P2, which is lower than the contact pressure created between the surface of the developing roller 58 and each end in the circumferential direction of the sealing member 35, thereby reducing torque for driving the developing roller 58 and heating of the sealing member 35. Accordingly, the sealing member 35 does not easily peel off from the bearing surfaces 31 through 33 compared to the comparative sealing member 35.

Further, in FIG. 6A, the sealing member 35 slidably contacts the developing roller 58 in a wide range between the bearing surface 31*b* and the bearing surface 32, in which the elastic member 35*a* included in the sealing member 35 is significantly deformed. By contrast, as illustrated in FIG. 9A, an entire outer surface of the sealing member 335 fixed to the toner container 351 restricts deformation of the elastic member 335*a*, thereby reducing an amount of deformation of the elastic member 335*a*. Accordingly, contact pressure of the sealing member 335 relative to the surface of the developing roller 358 may be partially increased.

Such partial increase in contact pressure causes wrinkles and/or tears in a double-sided tape through which toner may leak. In order to address such a problem, as illustrated in FIG. 6A, for example, the sealing member 35 is fixed, with the double-sided tape 35*d*1, only to the bearing surface 31*b* positioned upstream in the direction of rotation of the developing roller 58. In this case, the slide film 35*e* effectively prevents the sealing member 35 from being separated from the toner container 51 by not restricting movement of the elastic member 35*a* included in the sealing member 35 in the circumferential direction thereof at a portion other than the fixed portion.

Alternatively, in FIG. 6A, the sealing member 35 may be attached to the bearing surface 31*b* positioned upstream in the direction of rotation of the developing roller 58 and the bearing surface 32*b* positioned downstream in the direction of rotation of the developing roller 58 with the double-sided tapes 35*d*1 and 35*d*2 so as not to be separated from the toner container 51. Alternatively, the sealing member 35 may be attached to the bearing surface 31*b* and the bearing surface 33*b* with the double-sided tapes 35*d*1 and 35*d*2 so as not to be separated from the toner container 51. In other words, the unfixed portion of the sealing member 35 supported by the slide film 35*e* increases the amount of deformation of the elastic member 35*a* at the intermediate portion in the circumferential direction of the sealing member 35 in slidably contact with the developing roller 58, thereby preventing the sealing member 35 from having wrinkles and/or being separated from the toner container 51.

Alternatively, the downstream end of the sealing member 35 may be fixed to the bearing surface 32*b* or 33*b* or both the bearing surfaces 32*b* and 33*b* without fixing the upstream end of the sealing member 35 to the bearing surface 31*b*. In this case, however, the sealing member 35 may be deformed or have wrinkles because the sealing member 35 having the upstream end not fixed to the bearing surface 31*b* contacts the developing roller 58 in a manner opposite the direction of rotation of the developing roller 58.

Accordingly, the upstream end of the sealing member 35 is preferably fixed to the bearing surface 31*b* so that a portion of the sealing member 35 downstream from the upstream end thereof contacts the surface of the developing roller 58 in a manner following the direction of rotation of the developing roller 58, thereby preventing deformation and/or wrinkles of the sealing member 35.

In addition, a bottom surface (outer surface) of the sealing member 35 is partially attached to the toner container 51. Such facilitated attachment of the sealing member 35 improves efficiency of assembly and efficiency of removal of the sealing member 35 upon disassembly.

Figure 7A:
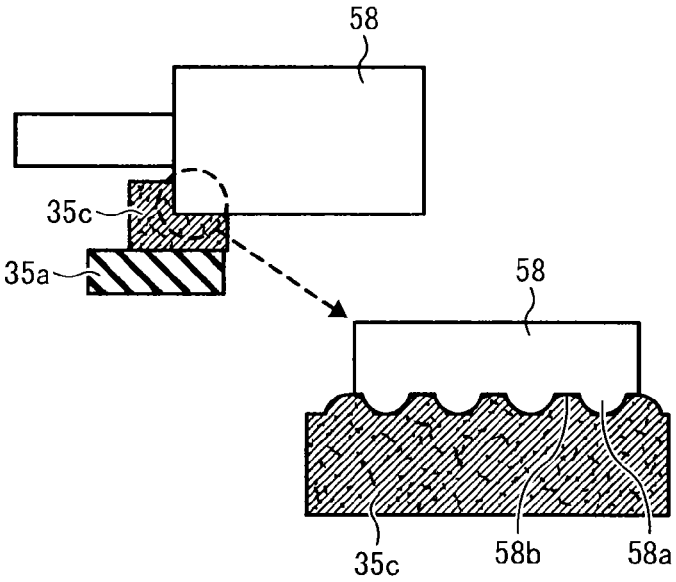
FIG. 7A is an enlarged cross-sectional view of a contact portion between a rotator and a sealing member according to at least one exemplary embodiment of this disclosure.
Figure 7B:
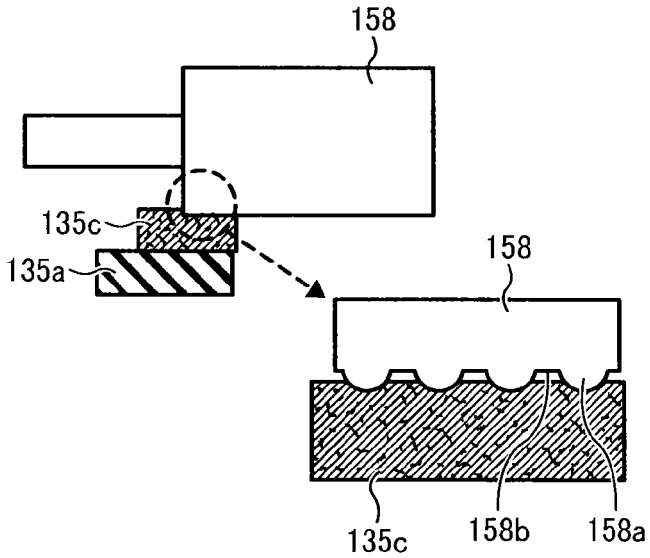
FIG. 7B is an enlarged cross-sectional view of a contact portion between a rotator and a sealing member according to a comparative example.

FIG. 7A is a schematic view for illustrating improvement in sealing performance achieved by using the elastic member 35*a* having low hardness. FIG. 7A is an enlarged cross-sectional view of a contact portion between a developing roller 58 and a sealing base 35*c* according to at least one exemplary embodiment. FIG. 7B is an enlarged cross-sectional view of a contact portion between a developing roller 158 and a sealing base 135*c* according to a comparative example.

A comparative sealing member 135 includes an elastic member 135*a* and a sealing base 135*c* both having high hardness enough to support high contact pressure. Therefore, as illustrated in FIG. 7B, a surface of the sealing base 135*c* contacts convex portions 158*a* of an uneven surface of the developing roller 158 without contacting concave portions 158*b* of the uneven surface of the developing roller 158.

However, in the above-described comparative sealing manner, fine toner particles may pass through gaps between the sealing base 135*c* and the developing roller 158. A sealing member 35 according to at least one exemplary embodiment has an elastic member 35*a* and a sealing base 35*c* both having low hardness so that the sealing base 35*c* contacts, in a complementary manner, both convex portions 58*a* and concave portions 58*b* of a surface of a developing roller 58. Accordingly, the surface of the developing roller 58 and the sealing base 35*c* do not create a gap therebetween, thereby preventing fine toner particles from passing between the surface of the developing roller 58 and the sealing base 35*c*.

Alternatively, the sealing base 35*c* may have an uneven surface as rough as the uneven surface of the developing roller 58 having or not having low hardness. The sealing base 35*c* having the uneven surface is pressed against the surface of the developing roller 58 by the elastic member 35*a* positioned under the sealing base 35*c*. Thus, the sealing base 35*c* is significantly deformed to fit the uneven surface of the developing roller 58 while applying low contact pressure to the surface of the developing roller 58.

The sealing base 35*c* used in the sealing member 35 according to at least one exemplary embodiment may be pile fabric having an uneven surface. The sealing base 35*c* pressed against the developing roller 58 under low pressure may not perfectly fit the uneven surface of the developing roller 58, resulting in toner leakage. In order to address such a problem and to effectively prevent toner leakage, the surface of the sealing base 35*c* may include a fibrous material having low variability, such as a pile material, or a slidable elastic member to follow the uneven surface of the developing roller 58. Accordingly, the surface of the developing roller 58 and the sealing base 35*c* do not create a gap therebetween, thereby effectively preventing the toner from leaking. Further, the sealing member 35 may have a compound structure with two or more layers by disposing the elastic member 35*a* under the sealing base 35*c*.

Figure 8A:
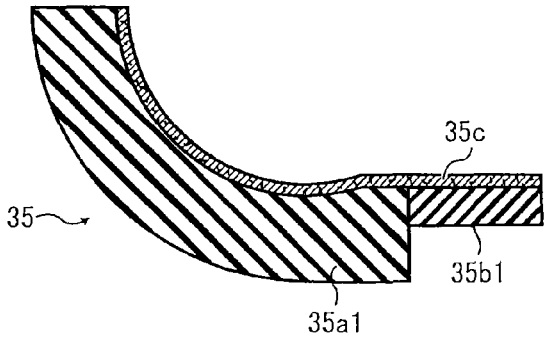
FIG. 8A is a cross-sectional view of a plastically deformed sealing member according to a fourth exemplary embodiment of this disclosure.
Figure 8B:
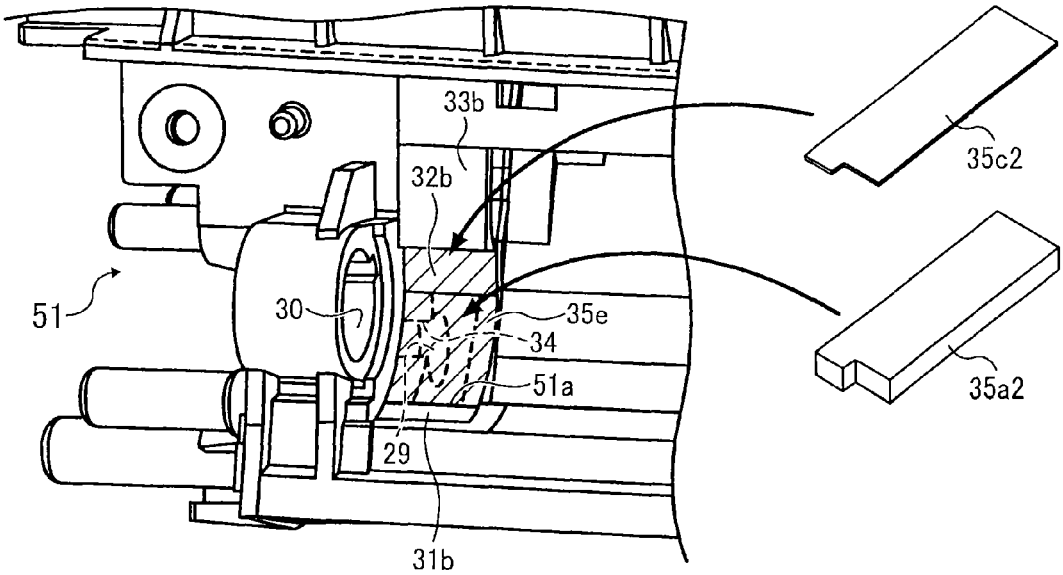
FIG. 8B is a perspective view of an example of separately installing a base material and an elastic member to a toner container according to the fourth exemplary embodiment.

FIGS. 8A and 8B illustrate a sealing assembly according to a fourth exemplary embodiment. A configuration of the sealing assembly according to the fourth exemplary embodiment is the same as the configuration of the sealing assembly according to the third exemplary embodiment which includes the slide film 35*e*, except that a sealing member 35 according to the fourth exemplary embodiment is plastically deformed as illustrated in FIG. 8A.

Typically, a sealing member is formed in a board shape as illustrated in FIGS. 4A through 4C before being attached to a toner container. It is not easy to install such a board-shaped sealing member to the toner container so as to precisely fit bearing surfaces along a curved surface of the toner container. Double-sided tapes such as those illustrated in FIG. 3B cannot be easily reattached to the sealing member and/or the bearing surfaces after being removed therefrom.

Figure 8C:
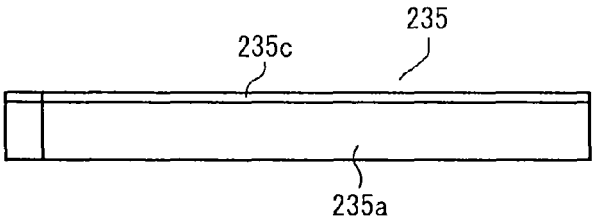
FIG. 8C is a cross-sectional view of a sealing member according to a comparative example.

FIG. 8C is a cross-sectional view of a comparative sealing member 235. The plate-shaped sealing member 235 includes a sealing base 235*c* and an elastic member 235*a* attached to each other. The elastic member 235*a* has a thickness relatively larger than a thickness of the sealing base 235*c* so that the sealing member 235 can be significantly deformed under low pressure. A sealing member, such as the sealing member 235 including the elastic member 235*a* having a relatively larger thickness, cannot be easily attached to a curved surface of a toner container which is concentrically formed with a developing roller, resulting in inaccurate assembly and installment.

In order to address such a problem, the sealing member 35 according to the fourth exemplary embodiment includes elastic members 35*a*1 and 35*b*1, and a sealing base 35*c*1 uniformly attached to each other, and is plastically deformed as illustrated in FIG. 8A. Such preliminary plastic deformation of the sealing member 35 to a shape in conformity with a curved surface of a toner container 51 facilitates installment of the sealing member 35 to the toner container 51, thereby achieving higher accuracy of assembly and installment.

Alternatively, an elastic member 35*a*2 and a sealing base 35*c*2 both in a plate shape are separately used as illustrated in FIG. 8B when the sealing member 35 cannot be plastically deformed in conformity with bearing surfaces along the curved surface of the toner container 51. In this case, the plate-shaped elastic member 35*a*2 is attached to a bearing surface of the toner container 51 with a double-sided tape. The plate-shaped sealing base 35*c*2 is attached on top of the elastic member 35*a*2 with the double-sided tape. Such a process of forming two layers of the elastic member 35*a*2 and the sealing base 35*c*2 facilitates installment of the sealing member 35 in conformity with the bearing surfaces along the curved surface of the toner container 51. Accordingly, inaccurate attachment of the sealing member 35 to the bearing surfaces is prevented, resulting in higher accuracy of assembly and installment.

It is to be noted that, although the developing roller 58 is depicted as a rotator in the above-described exemplary embodiments, the rotator is not limited to a cylindrical rotator such as the developing roller 58. The rotator may be a looped belt.

The sealing assembly according to the above-described exemplary embodiments may be applied to a sealing assembly used for a photoreceptor and a cleaning blade therefor, or to a sealing assembly used for a looped belt such as a transfer belt and a cleaning blade therefor. A sealing member for a photoreceptor or a transfer belt is pressed against the photoreceptor or the transfer belt under high pressure, causing a problem such that a surface of the photoreceptor or the transfer belt is shaved off and increased torque of the photoreceptor or the transfer belt. The sealing assembly according to the above-described exemplary embodiments prevents the surface of the photoreceptor or the transfer belt from being shaved off, and increase in torque thereof, thereby achieving a longer life of the photoreceptor or the transfer belt.

As described above, at least one of the exemplary embodiments of the present disclosure provide a sealing assembly that can reduce torque for driving a rotator by reducing friction between the rotator and a sealing member to obtain sufficient sealing performance, and provide a developing device, a process unit and an image forming apparatus incorporating the sealing assembly.

In the sealing assembly according to at least one of the exemplary embodiments, the intermediate portion in the circumferential direction of the sealing member contacts the rotator under pressure lower than pressure under which the ends in the circumferential direction of the sealing member contact the rotator. Accordingly, higher sealing performance can be achieved with a downsized, low-cost sealing assembly without adding new components to a typical sealing assembly. The sealing assembly according to at least one of the exemplary embodiments can reduce friction between the rotator and the sealing member to suppress heating, thereby preventing heat deterioration and destruction of the sealing member and the rotator. Accordingly, a longer life of the rotator and the sealing member can be achieved. In addition, a reinforced structure is not necessary.

Elements and/or features of different exemplary embodiments may be combined with each other and/or substituted for each other within the scope of this disclosure and appended claims. Exemplary embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims. The number of constituent elements and their locations, shapes, and so forth are not limited to any of the structure for performing the methodology illustrated in the drawings.

What is claimed is:

1. A sealing assembly to contact a rotator, the rotator disposed in an opening in a direction traversing the opening to convey powder held on a surface of the rotator from inside to outside the opening by rotation, the sealing assembly comprising:

a seal to slidably contact a surface of an end of the rotator in an axial direction of the rotator, wherein the seal has an end in a circumferential direction thereof to contact the surface of the rotator with a first pressure, the end in the circumferential direction is fixed to a bearing surface formed on the opening, on at least one of an upstream side and a downstream side in a rotation direction of the rotator, and the seal has an intermediate portion between an upstream end and a downstream end in the circumferential direction to contact the surface of the rotator with a second pressure lower than the first pressure, wherein each of the upstream end and the downstream end in the circumferential direction of the seal is fixed to the bearing surface, and wherein the seal has an unfixed portion in an outer surface of the intermediate portion.

2. The sealing assembly according to claim 1, wherein the seal comprises:

a pile material on an inner slide surface side; and an elastic member on an outer fixed surface side.

3. The sealing assembly according to claim 2, wherein the pile material and the elastic member are integrally provided in the seal, and the seal is plastically deformed along the surface of the rotator and the bearing surface.

4. The sealing assembly according to claim 2, wherein the pile material and the elastic member are separately configured, the elastic member is fixed to the bearing surface, and the pile material is fixed on the elastic member.

5. The sealing assembly according to claim 1, wherein the rotator is a cylinder.

6. The sealing assembly according to claim 1, wherein the rotator is an endless belt.

7. A developing device comprising:

a developing roller disposed in the opening in a direction traversing the opening to convey powder held on a surface thereof from inside to outside an opening by rotation; and the sealing assembly according to claim 1.

8. A process unit comprising the developing device according to claim 7.

9. An image forming apparatus comprising the process unit according to claim 8.

10. An image forming apparatus comprising the developing device according to claim 7.

11. An image forming apparatus comprising the sealing assembly according to claim 1.

12. A sealing assembly to contact a rotator, the rotator disposed in an opening in a direction traversing the opening to convey powder held on a surface of the rotator from inside to outside the opening by rotation, the sealing assembly comprising:

a seal to slidably contact a surface of an end of the rotator in an axial direction of the rotator, wherein the seal has an end in a circumferential direction thereof to contact the surface of the rotator with a first pressure, the end in the circumferential direction is fixed to a bearing surface formed on the opening, on at least one of an upstream side and a downstream side in a rotation direction of the rotator, and the seal has an intermediate portion between an upstream end and a downstream end in the circumferential direction to contact the surface of the rotator with a second pressure lower than the first pressure, wherein the intermediate portion is configured to contact a surface of a shaft core of another rotator via a slide member, the another rotator disposed inside the opening in parallel with the rotator to contact the surface of the rotator.

13. An image forming apparatus comprising the sealing assembly according to claim 12.

* * * * *